US005219195A

United States Patent [19]

Lawrence

[11] Patent Number: 5,219,195

[45] Date of Patent: Jun. 15, 1993

[54] WINDOW CLOSURE MECHANISM

[76] Inventor: Barry G. Lawrence, P.O. Box 846, Thomasville, N.C. 27360

[21] Appl. No.: 859,908

[22] Filed: Mar. 30, 1992

[51] Int. Cl.[5] ..... E05B 3/00

[52] U.S. Cl. ..... 292/336.3; 292/59; 292/207; 292/DIG. 33; 292/161

[58] Field of Search ..... 292/129, 161, 179, 336.3, 292/DIG. 31, DIG. 37, 106, 59, 207, DIG. 33; 49/394

[56] References Cited

U.S. PATENT DOCUMENTS

| | | | |
|---|---|---|---|
| 613,356 | 11/1898 | Conerly | 292/179 |
| 3,350,126 | 10/1967 | Walberg et al. | 292/179 |
| 4,179,143 | 12/1979 | Shy | 292/179 |
| 4,565,078 | 1/1986 | Solomon | 292/179 |
| 4,638,649 | 1/1987 | Chao | 292/DIG. 31 |
| 4,693,503 | 9/1987 | Bisbing | 292/DIG. 31 |
| 4,765,662 | 8/1988 | Suska | 292/254 |
| 4,803,808 | 2/1989 | Greisner | 49/394 |
| 5,060,492 | 10/1991 | Carpenter et al. | 292/DIG. 31 |

*Primary Examiner*—Peter M. Cuomo
*Assistant Examiner*—Michael Milano

[57] ABSTRACT

A closure mechanism for awnings and casement windows includes a flush, pivotal handle with a release mounted in a recessed housing. By depressing the release the handle is pivoted outwardly where it can be easily grasped by the user. Upon closing the window, depressing the handle allows the window to be tightly closed and latched within the frame as the handle is locked into a flush position on the window frame by a pawl which is resiliently urged into a notch in the handle within the housing.

10 Claims, 3 Drawing Sheets

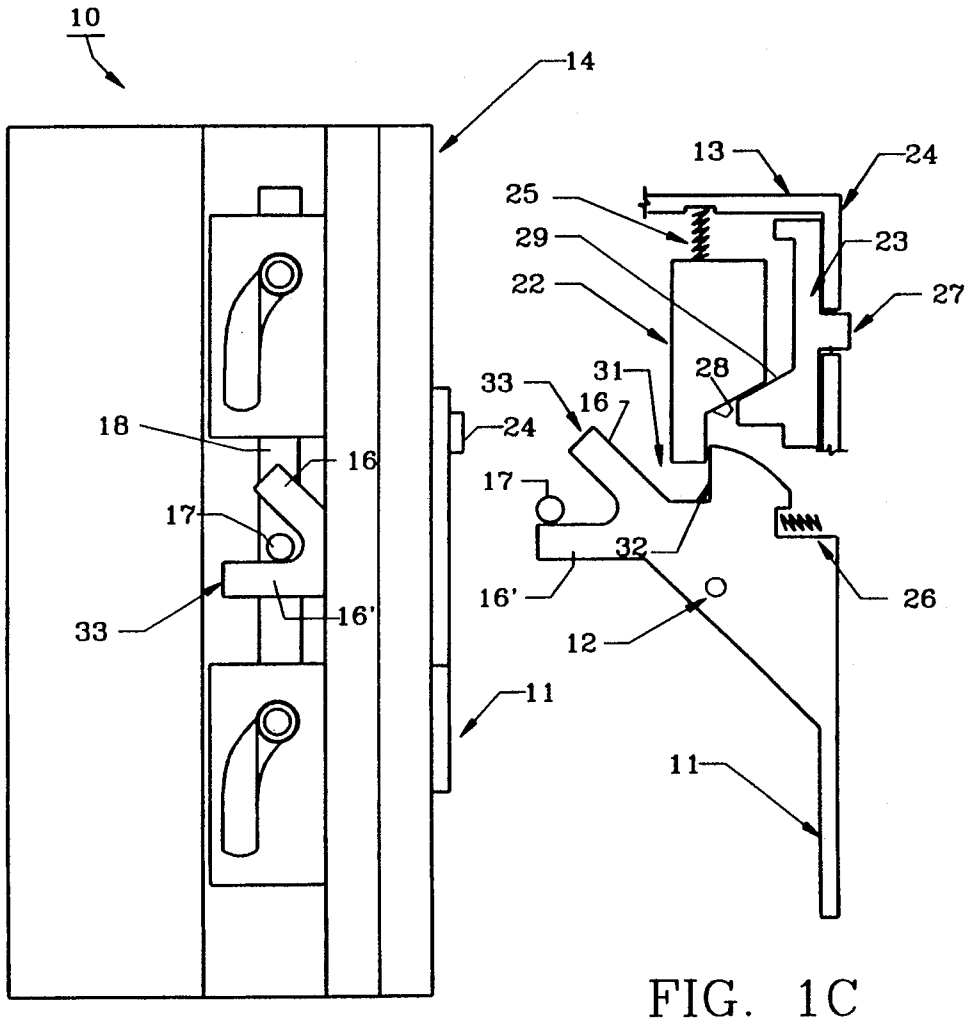
FIG. 1C
FIG. 1B
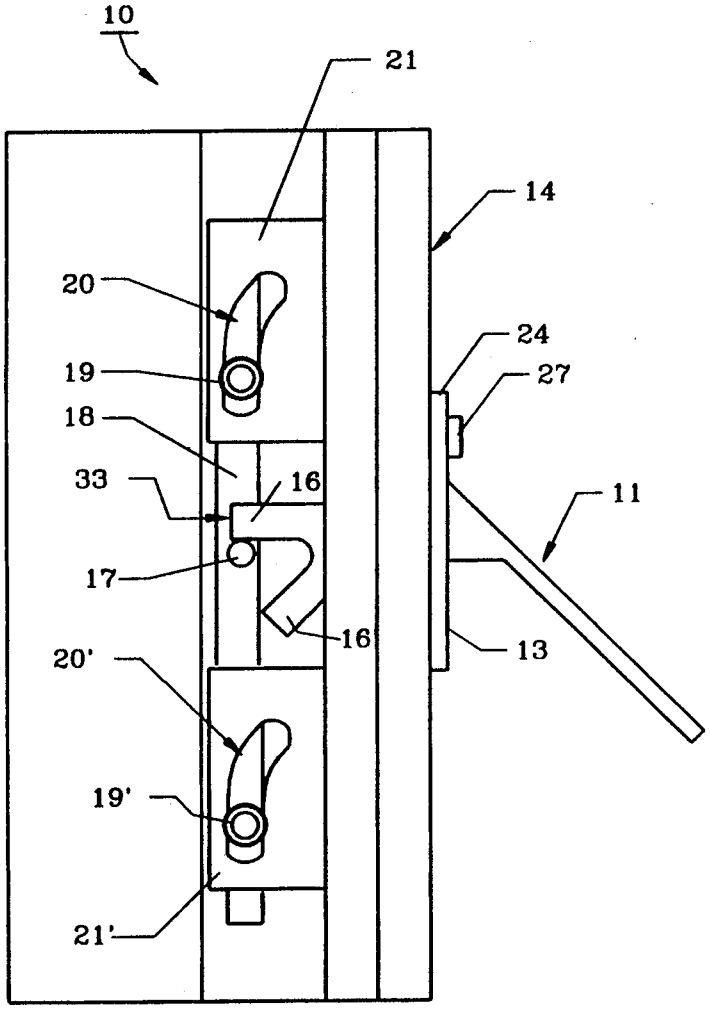
FIG. 1A

WINDOW CLOSURE MECHANISM

BACKGROUND OF THE INVENTION

1. Field Of The Invention

The invention herein pertains to closure mechanisms and particularly to mechanical mechanisms as are used to latch swinging windows such as casement and awning types.

2. Description Of The Prior Art And Objectives Of The Invention

Closure mechanisms have been used for many years to lock swinging type windows such as the awning and casement styles. Most factory supplied windows in the past several years have included wooden frames with hardware affixed or partially affixed with certain components to be installed at the job site. The installation of supplied hardware has generally not proven difficult since carpenters can use conventional tools. However, in recent years vinyl and aluminum frames have become popular and these frames are generally extruded to factory specifications. Thus, when these frames arrive at the job site, if hardware installation or adjustments have to be made, certain difficulties may be encountered due to the use of non-wood materials. However, in addition to the types of installation difficulties encountered with vinyl or aluminum window frames, many advantages are also provided.

It is therefore one objective of the present invention to provide a closure mechanism which is easily installed and adjusted in extruded vinyl or aluminum windows.

It is another objective of the present invention to provide a closure mechanism which includes a handle which is mounted in a housing that is recessed in the frame and which has a release button proximate thereto.

It is still another objective of the present invention to provide a closure mechanism which includes a pawl within the housing which is spring-loaded to lock the handle in a closed, flush position against the frame.

It is yet another objective of the present invention to provide a closure mechanism which, when installed in a frame, allows multiple frames to be stacked, thus saving space and shipping costs.

It is also another objective of the present invention to provide a closure mechanism which can be used with either a single point or a multi-point window catch for small or large windows respectively.

It is a further objective of the present invention to provide a closure mechanism which can be used in various extruded or fabricated window frames whether formed from wood, aluminum or vinyl.

It is also still another objective of the present invention to provide a closure mechanism which can be used on either awning or casement types windows to securely latch the closed window.

Various other objectives and advantages of the present invention become apparent to those skilled in the art as a more detailed presentation is set forth below.

SUMMARY OF THE INVENTION

The aforesaid and other objectives are realized by providing a mechanical closure mechanism in which a handle is substantially flushly positioned against the window frame yet can be readily extended as needed for ease in grasping. A release button is positioned above the handle and by finger pressure the release button activates a pawl to disengage it from the handle. When the pawl disengages, a resilient member forces the handle to rotate in a counterclockwise direction providing the user easy access. Once the handle has been released it extends from the frame and can be lifted to thereby direct a control rod downwardly to release the window and allow the window to be opened by a conventional crank or the like. When the window is to be closed it is urged towards the frame as by a crank and when substantially closed the handle is depressed, causing the control rod (in one embodiment) to force the window fully closed while allowing the pawl to engage the handle to thereby latch the window.

BRIEF DESCRIPTION OF THE DRAWINGS

FIG. 1A shows the mechanism of the invention as represented with the window partially open;

FIG. 1B presents the mechanism as seen in FIG. 1A but with the window tightly closed;

FIG. 1C shows the mechanism of the invention exposed for clarity;

DESCRIPTION OF THE PREFERRED EMBODIMENT

The preferred form of the invention is shown in FIGS. 1A, 1B and 1C whereby a flush mounted closure mechanism formed from aluminum is seen having a pivotal handle affixed within a housing recessed in a vinyl window frame. A spring-loaded pawl "locks" the handle by sliding into a handle notch and holds the handle in a flush posture with the front of the window frame. A release member or button which is exposed on the front of the frame disengages the spring-loaded pawl from the handle. The handle which is also spring-loaded includes a lever consisting of a pair of tines which extend to engage and move the control rod upwardly and downwardly engaging window catches on the window to thereby insure a tight closure of a casement type window.

DETAILED DESCRIPTION OF THE DRAWINGS AND OPERATION OF THE INVENTION

Figure 6:
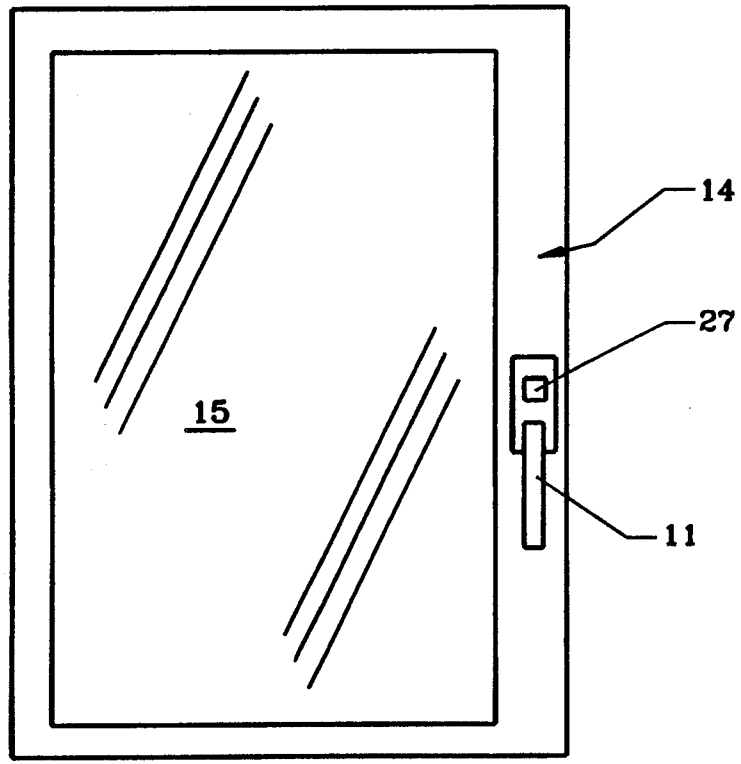
FIG. 6 shows a front view of a window installed with the closure mechanism as seen in FIGS. 1A, 1B and 1C.

Turning now to the drawings, closure mechanism 10 is shown in FIGS. 1A and 1B whereby handle 11 is pivotally mounted on axle 12 within housing 13. As further shown in FIGS. 1A, 1B and 1C, housing 13 is recessed within extruded vinyl front window frame 14 as seen in FIG. 6 which encloses casement window 15. As would be understood, window 15 comprises only one of a variety of windows that may be used with closure mechanism 10 and other devices may likewise use mechanism 10 such as cabinets or otherwise as desired. Windows with frame recesses are factory formed for easy installation and adjustment of the mechanism as needed at the job site.

As further seen in FIG. 1A, handle 11 includes lever 33 comprising a pair of tines 16, 16' which act on rod pin 17 which is affixed to control rod 18. As shown, control rod 18 includes a pair of terminal catch pins 19, 19' which move within grooves 20, 20' defined in catch pin guide members 21, 21' respectively. Handle 11 pivots to an open position as shown in FIG. 1A with tine 16 moving rod pin 17 to its downward most position whereas in FIG. 1B, rod pin 17 is shown in its uppermost position with tine 16' contacting pin 17. Control rods similar to rod 18 are conventional for awning or casement type windows.

As further shown in FIGS. 1A, 1B and 1C, housing 13 includes pawl 22 which engages release 23 which extends through front wall 24 of housing 13. As shown, release 23 provides a front "button" 27 immediately above handle 11 as seen in a different view in FIG. 6. Resilient pawl spring 25 urges pawl 22 into notch 31 formed by shoulder 32 of handle 11. When pawl 22 is released from handle 11, handle spring 26 drives handle 11 in a counterclockwise direction around axle 12. As further shown in FIGS. 1A and 1B, pawl 22 includes a biased surface 28 which slidably engages release biased surface 29 of release 23. Thus, when release button 27 is manually depressed, pawl 22 slides on surface 29 to thereby raise pawl 22 upwardly and allows handle 11 to pivot in a counterclockwise direction as a result of the pressure applied by handle spring 26. Pawl spring 25 urges pawl 22 downwardly into handle notch 31 until release thereof occurs.

Figure 4A:
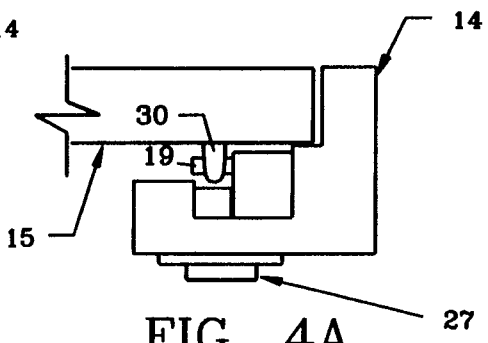
FIGS. 4A–4C depicts the components as seen in FIGS. 3A–3C but with the window in a fully closed posture.
Figure 4B:
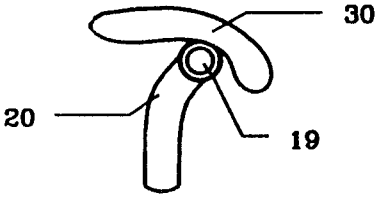
Figure 4C:
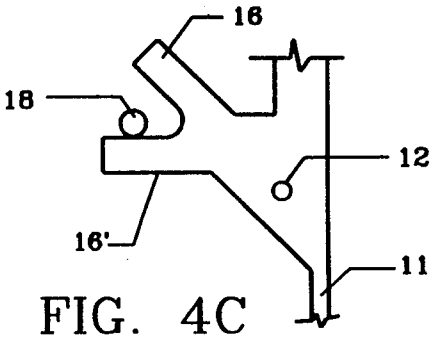
Figure 3A:
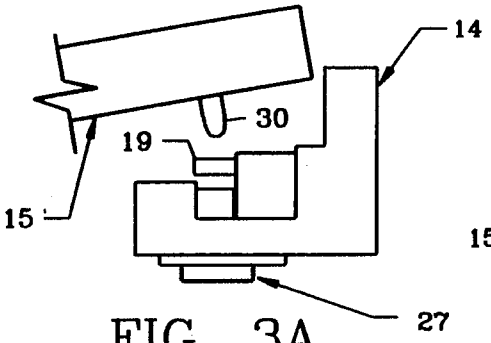
FIGS. 3A–3C illustrate certain components of the mechanism of FIG. 1A with the window in a partially open posture.
Figure 3B:
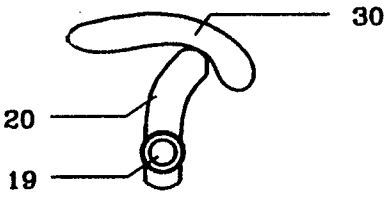
Figure 3C:
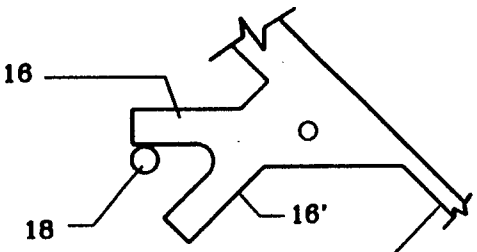
Figure 2:
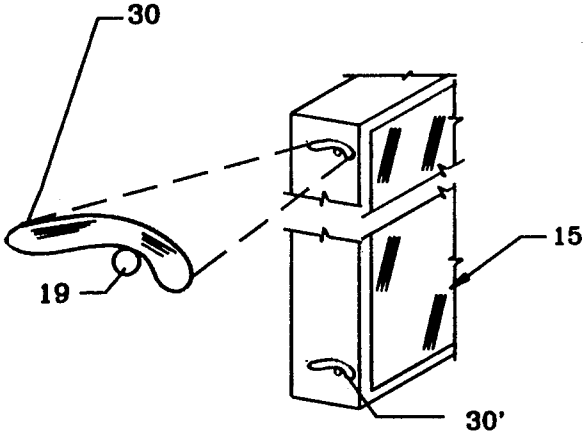
FIG. 2 demonstrates a side perspective view of a window with multi-catches.

In FIGS. 3A–3C the operation and component configuration of an "open" window is shown with front window frame 14 and window 15 almost closed. Window 15 includes a pair of hook catches 30, 30' as shown in FIG. 2 which engage catch pins 19, 19' respectively as shown in FIGS. 1A and 1B. As would be understood, catch pins 19, 19' pass outwardly through arcuate grooves 20, 20' and extend a sufficient distance to engage window catches 30, 30'. In FIG. 3B, window catches 30, 30' fit within recesses along the side of window 15 as also seen in FIG. 2. In FIGS. 4A–4C the components for a tightly closed window are presented in which window 15 has catch pin 19 at the most upper end of groove 20 along the bottom of window catch 30 with handle 11 being in a vertical, closed position. In FIG. 4C, rod pin 18 is against lower tine 16' whereas when window 15 in an open position, rod pin 18 rests against upper tine 16 (FIG. 3C).

Figure 5:
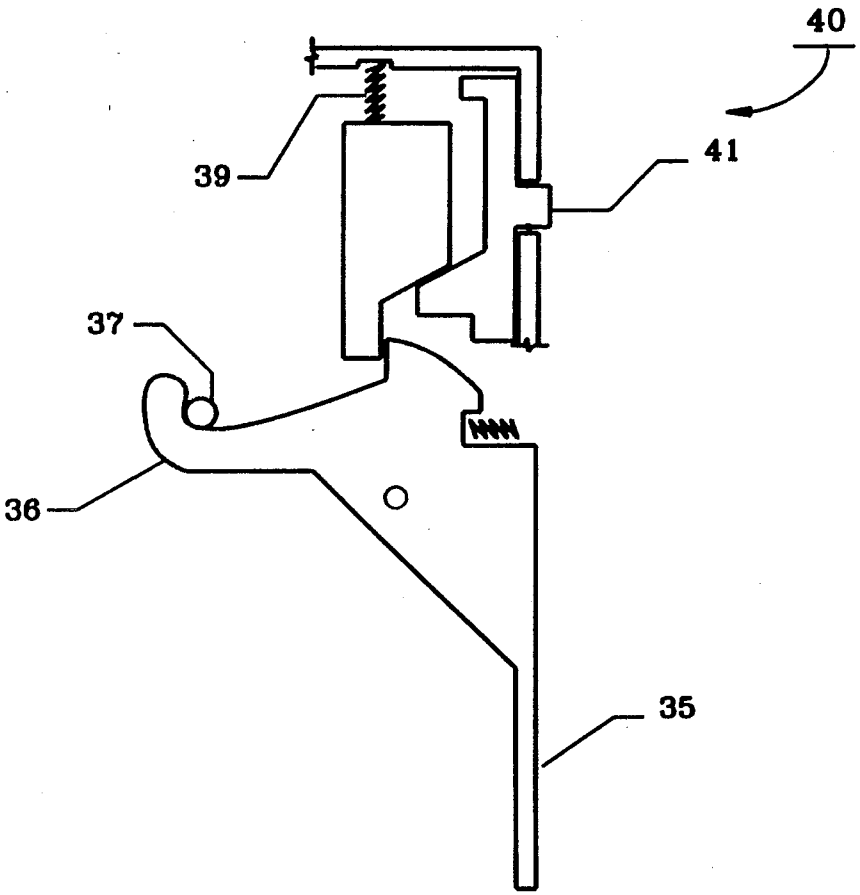
FIG. 5 pictures a second embodiment of the closure mechanism.

In another embodiment, window closure mechanism 40 in FIG. 5 includes handle 35 with lever 36. Lever 36 grasps single window pin 37 to pull the window (not seen in FIG. 5) inwardly, towards handle 35 as handle 35 is rotated clockwise or downwardly to completely, tightly shut the window. Closure mechanism 40 as shown in FIG. 5 would be useful for small casement windows and the like and includes pawl 39 and release 41 within housing 42, similar to mechanism 10 as shown in FIGS. 1A and 1B.

The illustrations and examples provided herein are for explanatory purposes and are not intended to limit the scope of the appended claims.

I claim:

1. A closure mechanism comprising: a pivotable handle, said handle pivotable from an open to a closed posture, a movable control rod, a catch pin, said pin joined to said control rod, said handle contracting said control rod for movement therewith, a pawl, said pawl for engagement with said handle to maintain said handle in a closed posture, a handle release, said release slidably engageable with said pawl to withdraw said pawl from engagement with said handle to thereby allow said handle to pivot to an open posture.

2. A closure mechanism as claimed in claim 1 and including a resilient member, said resilient member in contact with said pawl to urge said pawl into engagement with said handle.

3. A closure mechanism as claimed in claim 1 and including a handle housing, said pawl contained within said housing.

4. A closure mechanism as claimed in claim 1 wherein said handle comprises a lever.

5. A closure mechanism as claimed in claim 4 wherein said lever comprises a pair of tines.

6. A closure mechanism as claimed in claim 1 and including a catch pin guide, said guide containing said catch pin.

7. A closure mechanism as claimed in claim 6 wherein said catch pin guide defines an arcuate groove.

8. A closure mechanism comprising: a pivotable handle, a handle housing, said handle joined to said housing, a pawl, said pawl movably positioned within said housing to engage said handle, a handle release, said release extending through said housing, said release for slidably contacting said pawl to withdraw said pawl from engagement with said handle, said handle comprising a lever, a movable control rod, a catch pin, said pin joined to said control rod, said lever for directing the movement of said control rod.

9. A closure mechanism as claimed in claim 8 and including a resilient member, said resilient member contained within said housing, said handle defining a notch, said resilient member for urging said pawl into said notch.

10. A closure mechanism as claimed in claim 8 wherein said lever comprises a pair of tines.

* * * * *